US010480346B2

(12) United States Patent
Leykauf

(10) Patent No.: US 10,480,346 B2
(45) Date of Patent: Nov. 19, 2019

(54) HYDRAULIC CONTROL DEVICE FOR AN EMERGENCY STOP VALVE OF A STEAM TURBINE AND STEAM TURBINE ARRANGEMENT

(71) Applicant: VOITH PATENT GMBH, Heidenheim (DE)

(72) Inventor: Matthias Leykauf, Buehlerzell (DE)

(73) Assignee: Voith Patent GmbH, Heidenheim (DE)

( * ) Notice: Subject to any disclaimer, the term of this patent is extended or adjusted under 35 U.S.C. 154(b) by 371 days.

(21) Appl. No.: 15/316,261

(22) PCT Filed: Jun. 3, 2015

(86) PCT No.: PCT/EP2015/062348
§ 371 (c)(1),
(2) Date: Dec. 5, 2016

(87) PCT Pub. No.: WO2015/185607
PCT Pub. Date: Dec. 10, 2015

(65) Prior Publication Data

US 2017/0152759 A1 Jun. 1, 2017

(30) Foreign Application Priority Data

Jun. 3, 2014 (DE) ..... 10 2014 210 421

(51) Int. Cl.
*F01D 21/02* (2006.01)
*F01D 17/26* (2006.01)
(Continued)

(52) U.S. Cl.
CPC ..... *F01D 21/02* (2013.01); *F01D 17/26* (2013.01); *F01D 21/18* (2013.01); *F15B 20/001* (2013.01);
(Continued)

(58) Field of Classification Search
CPC ..... F01D 17/26; F01D 21/02; F01D 21/18; F05D 2220/31; F15B 20/001; F15B 20/008
See application file for complete search history.

(56) References Cited

U.S. PATENT DOCUMENTS 4,637,587 A * 1/1987 Kuhnlein ..... G05B 9/03 251/29
5,143,119 A * 9/1992 Plangger ..... F01D 17/26 137/557
(Continued)

FOREIGN PATENT DOCUMENTS

CN 202280483 U 6/2012
CN 103195503 A 7/2013
(Continued)

*Primary Examiner* — Jesse S Bogue
(74) *Attorney, Agent, or Firm* — Laurence A. Greenberg; Werner H. Stemer; Ralph E. Locher

(57) ABSTRACT

A hydraulic control device for an emergency stop valve of a steam turbine has a module for reducing a hydraulic pressure by rapid opening of an outflow valve and/or unloading or loading an actuator for actuating the emergency stop valve. In an operating medium supply and/or conducting system a control valve arrangement with at least three safety valves is provided, which are hydraulically interconnected such that they open the outflow valve or unload or load the actuator only when a safety circuit by way of at least two safety valves of the control valve arrangement has assumed an emergency stop position. A precontrol valve that is independent from the remaining safety valves is hydraulically connected upstream of each safety valve. A safety valve that is connected downstream of a respective precontrol valve can be hydraulically decoupled from the same during the operation.

13 Claims, 4 Drawing Sheets

(51) Int. Cl.
*F01D 21/18* (2006.01)
*F15B 20/00* (2006.01)

(52) U.S. Cl.
CPC ..... *F15B 20/008* (2013.01); *F05D 2220/31* (2013.01)

(56) References Cited

U.S. PATENT DOCUMENTS 5,626,070 A * 5/1997 Sorbel ..... E02F 9/2025 91/459
6,116,258 A * 9/2000 Shapiro ..... F01D 17/145 137/1
6,155,282 A * 12/2000 Zachary ..... G05B 9/03 137/1
6,435,202 B2 * 8/2002 Zachary ..... G05B 9/03 137/1
7,322,270 B2 1/2008 Schmieding
7,409,965 B2 * 8/2008 Blaser ..... F01D 17/145 137/553
7,499,761 B2 * 3/2009 Zachary ..... F15B 19/00 137/1
8,151,813 B2 * 4/2012 Jacoby ..... G05B 9/03 137/1
9,896,962 B2 * 2/2018 Wojick ..... F01D 21/18
10,119,478 B2 * 11/2018 Been ..... F15B 20/008
2012/0114460 A1 * 5/2012 Cole ..... F01D 17/145 415/43
2014/0026747 A1 1/2014 Finke et al.

FOREIGN PATENT DOCUMENTS

DE 102004042891 B3 10/2005
DE 202011109158 U1 1/2012
DE 102011116472 A1 5/2012
DE 102011082599 A1 3/2013
EP 0433791 A1 6/1991
EP 0641919 B1 6/1997

* cited by examiner

HYDRAULIC CONTROL DEVICE FOR AN EMERGENCY STOP VALVE OF A STEAM TURBINE AND STEAM TURBINE ARRANGEMENT

BACKGROUND OF THE INVENTION

Field of the Invention

The invention relates to a hydraulic control device for an emergency stop valve of a steam turbine, The hydraulic control device has a module for the reduction of a hydraulic pressure by rapid opening of an outflow valve and/or unloading or loading an actuator for actuating the emergency stop valve; in an operating medium supply and/or conducting system a control valve arrangement with at least three safety valves is provided, which are hydraulically interconnected in such a manner that these open the outflow valve or unload or load the actuator only when a safety circuit by way of at least two safety valves of the control valve arrangement has assumed an emergency stop position. The invention, furthermore, relates to a steam turbine arrangement.

Steam turbines, for example in power stations, in which live steam from a boiler is expanded and in the process drives one or more turbine stages, must not exceed certain maximum rotational speeds in order to prevent in particular damaging the turbine components. In order to avoid that this maximum rotational speed is exceeded by the turbine during a load dump or a coupling breakage or the like, it is known for example from DE 10 2004 042 891 B3 to provide an emergency stop valve which in as short as possible a time interrupts or reduces the steam mass flow to the turbine when for example the turbine rotational speed exceeds a predetermined threshold value or an impending exceeding of the maximum rotational speed is detected in another way.

Consequently, high availability, safety and reliability requirements are made on such emergency stop valves and their activation. Usually, an emergency stop valve therefore comprises a working cylinder or actuator which is lifted by a hydraulic pressure against a preload element, for example a spring and thus actively opens the emergency stop valve, for as long as the hydraulic pressure overcomes the preload of the preload element. For closing the emergency stop valve, this hydraulic pressure is reduced as quickly as possible, for example discharged in a controlled manner into a tank. The pressureless working cylinder is forced by the preload element into the closed position of the emergency stop valve.

To this end, DE 10 2004 042 891 B3 proposes a control device for an emergency stop valve of a steam turbine with a module for reducing a hydraulic pressure by quickly opening an outflow valve, wherein a control valve arrangement with at least three safety transfer valves is provided, which are hydraulically interconnected in such a manner that these close the emergency stop valve only when at least two safety transfer valves of the control valve arrangement have assumed an emergency stop position. The control device is designed in such a manner that the hydraulic pressure, when a defined event occurs, can be reduced almost immediately. This is described as a so-called 2oo3 connection (two out of three).

By way of a test control valve arrangement a test, in particular a so-called partial stroke test of the emergency stop valve can be carried out in that, starting out from the emergency stop valve which is for example completely opened or opened into a normal operating position, the hydraulic pressure is initially reduced in such a manner that the emergency stop valve closes entirely or at least partially in that for example the working cylinder or actuator performs a full or a partial stroke. Following this the hydraulic pressure is increased again and the emergency stop valve thus moved back into its starting position.

By way of this test, which can be carried out before, during and/or after the working operation of the turbine, the function of the emergency stop valve can be checked independently of the control valve arrangement of the safety valves and thus a sluggishness or seizure, for example through scale deposit, can be detected.

DE 10 2011 082 599 A1 shows a valve arrangement as it can be used for example for turbines. This valve arrangement comprises a 2oo3 logic. To this end, a first, a second and a third precontrol valve are provided, wherein each of these precontrol valves controls two safety valves. Because of this, three connection branches are obtained, wherein the valve arrangement is characterized in that the safety valve is divided into inlet and outlet valves and these are coupled in such a manner that the inlet and outlet valves overlap across connection branches. This means that in each case two of the inlet valves and two of the outlet valves are serially connected to one another in order to jointly form the connection branches. It is provided that three precontrol valves are each assigned two inlet valves and two outlet valves. Here, an arrangement is provided that one of the two inlet valves and one of the two outlet valves are arranged in the first connection branch and the other inlet valve and the other outlet valve are arranged in the further connection branch, but the other outlet valve is fed on the first connection branch.

A precontrol valve according to the prior art is thus assigned to a plurality of inlet and outlet valves even in different connection branches. When a precontrol valve is defective, this accordingly affects two connection branches. A redundant switching technology, such as for example a "2oo3" connection is no longer functional.

If one of the precontrol valves is defective, for example the detection device on the multi control valve, the sensor or the like, the running operation therefore has to be interrupted or at least the so-called TRIP function be waived.

The TRIP function consists in immediately switching off a steam turbine, for example in an emergency. In the process, three safety transfer valves are switched. The triggering is effected via a 2oo3 (two out of three) connection. This means the controlled discharge of the control fluid for tripping is effected by actuating at least two safety transfer valves.

From the publication EP 0433 791 A1 an embodiment with three safety valves in the form of transfer valves with solenoid valves assigned to the safety valves for actuating the same is known. Upon a failure of one of the safety valves, the operation of the safety valve can nevertheless be maintained by closing the actuating valve assigned to the same. Here, the actuation valves only serve as actuation element of the safety valve and have no influence on the inflow to the safety valve, which is why a replacement of a single safety valve during running operation is not possible.

BRIEF SUMMARY OF THE INVENTION

The object of the invention consists in providing a control device with an emergency stop valve for the operation of a turbine, with which, in the case of a defect of a safety valve, the same can be replaced during running operation.

The solution according to the invention is characterized by the claimed features. Advantageous further developments are reflected in the dependent claims.

A hydraulic control device for an emergency stop valve of a steam turbine with a module for reducing a hydraulic pressure by rapid opening of an outflow valve and/or unloading or loading an actuator for actuating the emergency stop valve, wherein in an operating medium supply and/or conducting system a control valve arrangement with at least three safety valves is provided, which are hydraulically interconnected in such a manner that these open the outflow valve or unload or load the actuator only when a safety circuit by way of at least two safety valves of the control valve arrangement has assumed an emergency stop position is characterized in that a precontrol valve that is independent from the remaining safety valves is hydraulically connected upstream of each safety valve in such a manner that a safety valve that is connected downstream of a respective precontrol valve can be hydraulically decoupled from the same during the operation.

Hydraulically connected upstream in this case is to mean an upstream arrangement in flow direction from a pressure source to a pressure trough.

"Hydraulically coupled" or "decoupled" includes in particular directly or indirectly connected hydraulically via further connection ducts, lines, spaces or components arranged in between or an assurance or interruption of a fluid connection.

The basic idea of the invention consists in assigning each safety valve a precontrol valve, wherein the precontrol valves are preferentially coupled to one another. Because of this it is possible to replace a defective safety valve during the running operation. For this purpose, the precontrol valve, which is assigned to the defective safety valve, switches into a position that the safety valve connected downstream can be removed but the applied pressure is nevertheless passed on so that the running operation is not interrupted. Here, the emergency stop function is automatically changed from a 2oo3 to a 1oo2 (one out of two) connection.

This circuit arrangement can also be realized in a single device so that a compact arrangement materializes.

In an advantageous design, the three precontrol valves are hydraulically coupled to one another. Coupling is preferentially effected in such a manner that these are each coupled to a connection line which is connected to the pressure source and to a connection line that is connected to the pressure trough. Connecting the precontrol valves to a pressure trough and a pressure source or a T and a P line serves for reducing the P and T connectors to a minimum on the hydraulic block. T in this case stands for tank and P for pressure source. Coupling the remaining lines serves for the 1oo2 changeover when actuating a precontrol valve.

In a further development, the individual precontrol valves are connected in parallel. This allows an operating mode that is independent of the other precontrol valves free of impairment of the connection of the other precontrol valves with the safety valves.

Specifically, the individual precontrol valve preferentially comprises at least two valve positions—a first valve position, in which a connector for the at least indirect coupling of the precontrol valve is connected with a pressure source in terms of fluid with a connector for the at least indirect connection in terms of fluid with a connector on the safety valve and a second valve position, in which a connector for the at least indirect coupling of the precontrol valve with a pressure source in terms of fluid is separated from a connector for the at least indirect connection in terms of fluid with a connector on the safety valve.

According to a particularly advantageous embodiment, the individual precontrol valve is designed as a multiple transfer valve, in particular 6/2-way valve. With the same, a plurality of tasks can be realized in a high concentration of functions and minimal expenditure with one component. By embodiment as 6/2-way valve, multiple functions such as decoupling the safety valve for replacement of the same and connecting the remaining safety valves with a pressure trough (for 1oo2 changeover) can be realized by actuating only one valve.

In a particularly advantageous further development it is provided that the individual safety valve is designed as safety transfer valve, comprising at least two connectors—a connector for the at least indirect coupling with a pressure source and a connector for the at least indirect coupling with a pressure trough—and with at least two valve positions, wherein in a first valve position the connector on the safety transfer valve for the at least indirect connection in terms of fluid with the precontrol valve connected upstream of the respective safety transfer valve in terms of fluid with a connector on the safety transfer valve for the at least indirect coupling with a pressure trough is disconnected or shut off and in a second valve position the connector on the safety transfer valve for the at least indirect connection in terms of fluid with the precontrol valve connected upstream of the respective safety transfer valve in terms of fluid is connected to a connector on the safety transfer valve for the at least indirect coupling with a pressure trough.

Particularly preferably, the individual safety transfer valve is designed as 4/2-way valve, comprising two connectors in each case for the connection in terms of fluid with connectors on the precontrol valve connected upstream of the safety transfer valve, a connector for coupling with a pressure trough and a connector for the coupling in terms of fluid with a connector on one of the other precontrol valves.

In a further development, for carrying out a partial stroke test a test control valve arrangement with at least one transfer valve arranged in series is additionally provided. By way of this test, the function of the emergency stop valve can be checked independently of the control valve arrangement of the safety valves.

A steam turbine arrangement designed according to the invention with a steam mass flow supply and an emergency stop valve in the steam mass flow supply is preferentially characterized by a hydraulic control device assigned to the emergency stop valve as claimed. In addition to a redundant valve arrangement, this offers the possibility of replacing one of the safety valves during running operation, which increases the availability of the plant as a whole and prevents unnecessary down times.

BRIEF DESCRIPTION OF THE SEVERAL VIEWS OF THE DRAWING

The solution according to the invention is explained in the following by way of figures. There.

DESCRIPTION OF THE INVENTION

Figure 1:
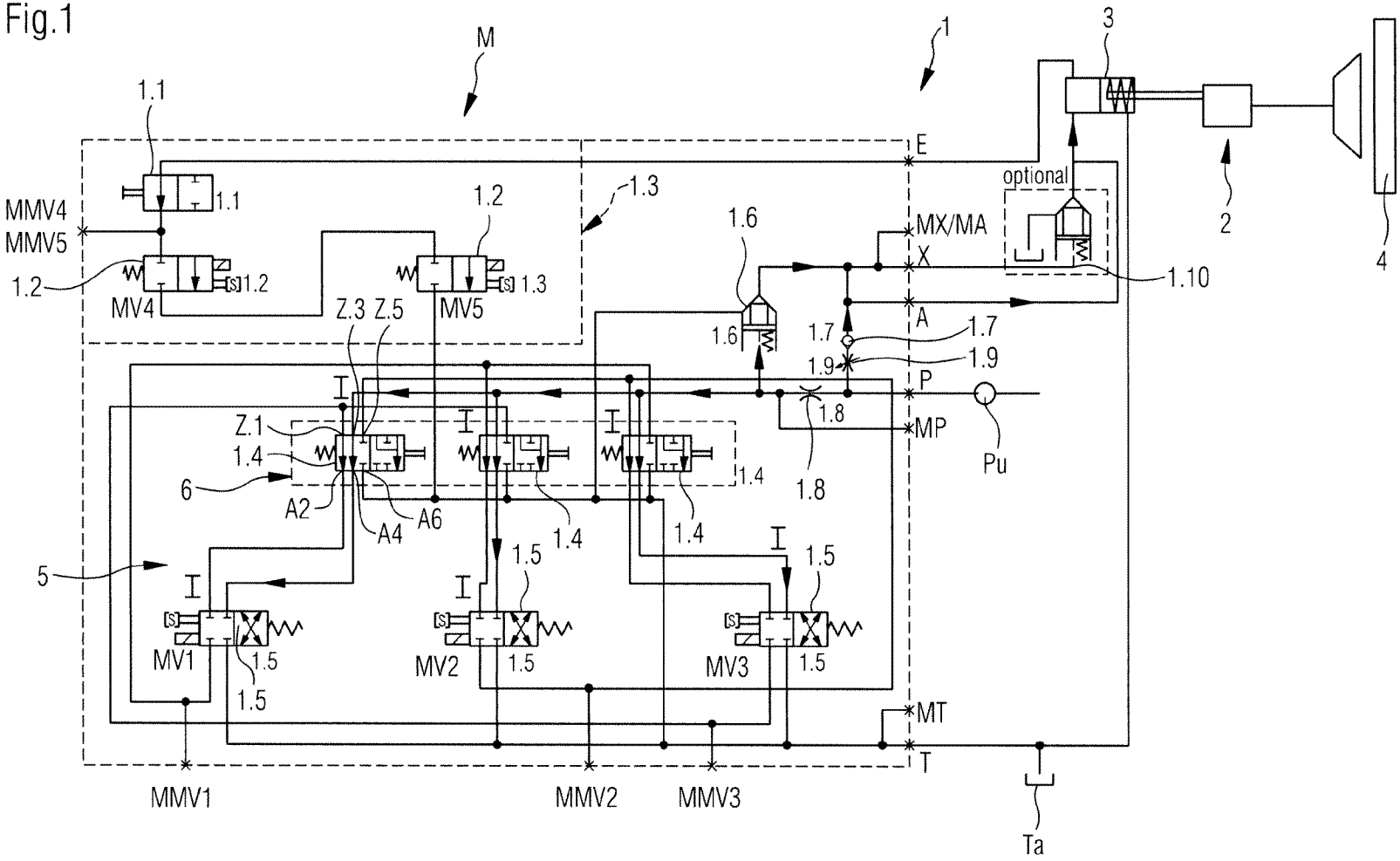
FIG. 1 shows a control device for operating a turbine with an emergency stop valve during normal operation.

FIG. 1 shows a control device 1 with a module M for operating a turbine 4, in particular steam turbine 4 with an emergency stop valve 2 during normal operation. The hydraulic control device 1 for an emergency stop valve 2 of a steam turbine 4 comprises a module M for reducing a hydraulic pressure through quick actuation, in particular opening of a valve, here of an outflow valve 1.6 and/or for loading or unloading an actuator 3 for actuating the emergency stop valve 2, here for unloading the actuator 3 in the form of a cylinder-piston arrangement by way of the opening of the outflow valve 1.6 and a control valve arrangement 6 arranged in an operating medium supply and/or conducting system 5. The control valve arrangement 6 to this end comprises at least two, preferentially, as reflected in FIG. 1, three safety valves which are hydraulically interconnected in such a manner that these only open the outflow valve 1.6 when a safety circuit by way of at least two safety valves, here safety transfer valves 1.5 of the control valve arrangement, have moved into a position which is also described as emergency stop position. The safety valves in this case are designed as safety transfer valves 1.5, preferentially as electromagnetically actuatable multiple transfer valves, in particular 4/2-way valves MV1, MV2 and MV3 and characterized by at least two switching positions. A first switching position I in this case blocks the connection between a connector on the valve that can be connected to a pressure medium source, in particular pump Pu and a pressure trough, in particular tank Ta, while in the second switching position II there is the connection between the connector on the valve that can be connected with a pressure medium source and a pressure trough, or a connector on the valve that can be connected with the pressure trough.

According to the invention, a precontrol valve 1.4 in the form of a multiple transfer valve is hydraulically connected upstream each safety valve, in particular safety transfer valve 1.5, wherein the individual precontrol valve 1.4 is designed in such a manner to make possible in at least one valve position a hydraulic shutting-off of the safety valve 1.5 connected downstream of the same. Hydraulically connected upstream means that the safety valve 1.5 in through-flow direction between pressure source Pu and pressure trough Ta is arranged downstream of the precontrol valve 1.4 and there is a fluid-conducting connection between an individual precontrol valve 1.4 and a safety valve 1.5. The individual precontrol valve 1.4 is characterized by at least two switching positions, wherein one of the two switching positions corresponds to the valve position which makes possible a hydraulic shutting-off or decoupling of the safety transfer valve 1.5 from the precontrol valve 1.4.

The shown module M, in a particularly advantageous embodiment, each comprises three such safety transfer valves 1.5 and in each case a precontrol valve 1.4 connected upstream of the safety transfer valves 1.5. In this way it is achieved that for realizing the emergency stop function at least two of the safety transfer valves 1.5 always have to be in the first switching position intended for this purpose.

In FIG. 1, the control device 1 and in particular the valve position during normal operation are reflected. The pump Pu pumps the control fluid present in the lines into the precontrol valves 1.4 that are located in a first position I. In the same, there is a hydraulic connection to the safety transfer valve 1.5 arranged downstream of the individual precontrol valve 1.4, in particular the connector provided on the valve for the direct or indirect connection with a pressure medium source via further units arranged in between. The individual precontrol valve 1.4 is opened, so that the control fluid is conducted from the respective precontrol valves 1.4 to the multiple transfer valves 1.5. After the voltage supply (not shown in the drawings) has been switched on, the safety multiple transfer valves 1.5 attract and take up the position I shown in FIG. 1. In this first valve position I, the shown multiple transfer valves 1.5 are closed, i.e. there is no fluid-conducting connection between the connector for the direct or indirect coupling with the pressure medium source and the connector for the direct or indirect coupling with the pressure trough. The connections in terms of fluid of connector P (in the region of the pump Pu as pressure medium source) and connector T (in the region of the tank Ta as pressure medium trough) are thus closed. The control fluid which flows in via an adjustable throttle 1.9 and a non-return valve 1.7 in the region of the connector P with the pump Pu flows via a connector A into the actuator 3, where it actuates the piston rod and actuates the emergency stop valve 2 connected thereto.

When two or three safety transfer valves 1.5 in any combination or order are switched off, the connection between the connector P and the connector T is established. The control fluid can flow out into the tank Ta. The control fluid of the actuator 3 then flows off via an outflow valve 1.6 to the tank Ta. The emergency stop time is dependent on the spring force of the actuator 3.

The emergency stop can also optionally (shown in dashed line in FIG. 1: in the remaining ones, shown as being present) be supported additionally via an external outflow valve 1.10. By use of an externally attached outflow valve 1.10, the emergency stop time, dependent on the rated size of the valve, can be correspondingly shortened. The coupling-up in terms of fluid is effected via the connector X on the control device 1, in particular the module M.

For checking the emergency stop valve 2 and its function, a test control valve arrangement 1.3 is provided. The same comprises a first multiple transfer valve 1.1, here a 2/2-way valve and two further multiple transfer valves 1.2, here 2/2-way valves MV4 and MV5. When the multiple transfer valves 1.2 are switched, the actuator 3 moves out of its corresponding position. The module M and the test control valve arrangement 1.3 preferably form a structural unit. In particular, these two part units can form a compact block and be fastened to one another and/or a carrier. This facilitates the assembly of the complete control device 1 and reduces the required installation space. The module M and/or the test control valve arrangement 1.3 preferably comprise an end position monitoring device in order to determine whether the valves operate properly, i.e. assume the activated end position (open or closed position).

The safety transfer valves 1.5, in particular multiple transfer valves MV1, MV2 and MV3 are preferably designed as 4/2 way solenoid valve. Preferably, valves of the module M in this case connect the actuator 3 with the tank Ta formed as pressure trough or separate it from the pump Pu formed as pressure source when they are not supplied with energy, i.e. in the currentless state open the emergency stop valve 2. In the same way, the first and/or second transfer valve 1.2, here 2/2-way valve MV4 and/or MV5 of the test control valve arrangement 1.3 preferably connect the emergency stop valve 2 with the pressure trough, while they separate the same from the pressure source, when they are supplied with energy, i.e. close the emergency stop valve 2 in the energized state. However, the obverse currentless position is also possible.

The precontrol valve 1.4 formed as multiple transfer valve is preferentially designed for realizing a wide range of functions as 6/2-way valve. In the operating mode described in FIG. 1, the same is located in the position I. In position I of the 6/2-way valve, the inlet Z1 is connected with the outlet A2, the inlet Z3 with the outlet A4. Inlet Z5 and outlet A6 are closed. Outlet A2 and outlet A4 in turn are connected in terms of fluid with the corresponding safety transfer valve 1.5.

Figure 2:
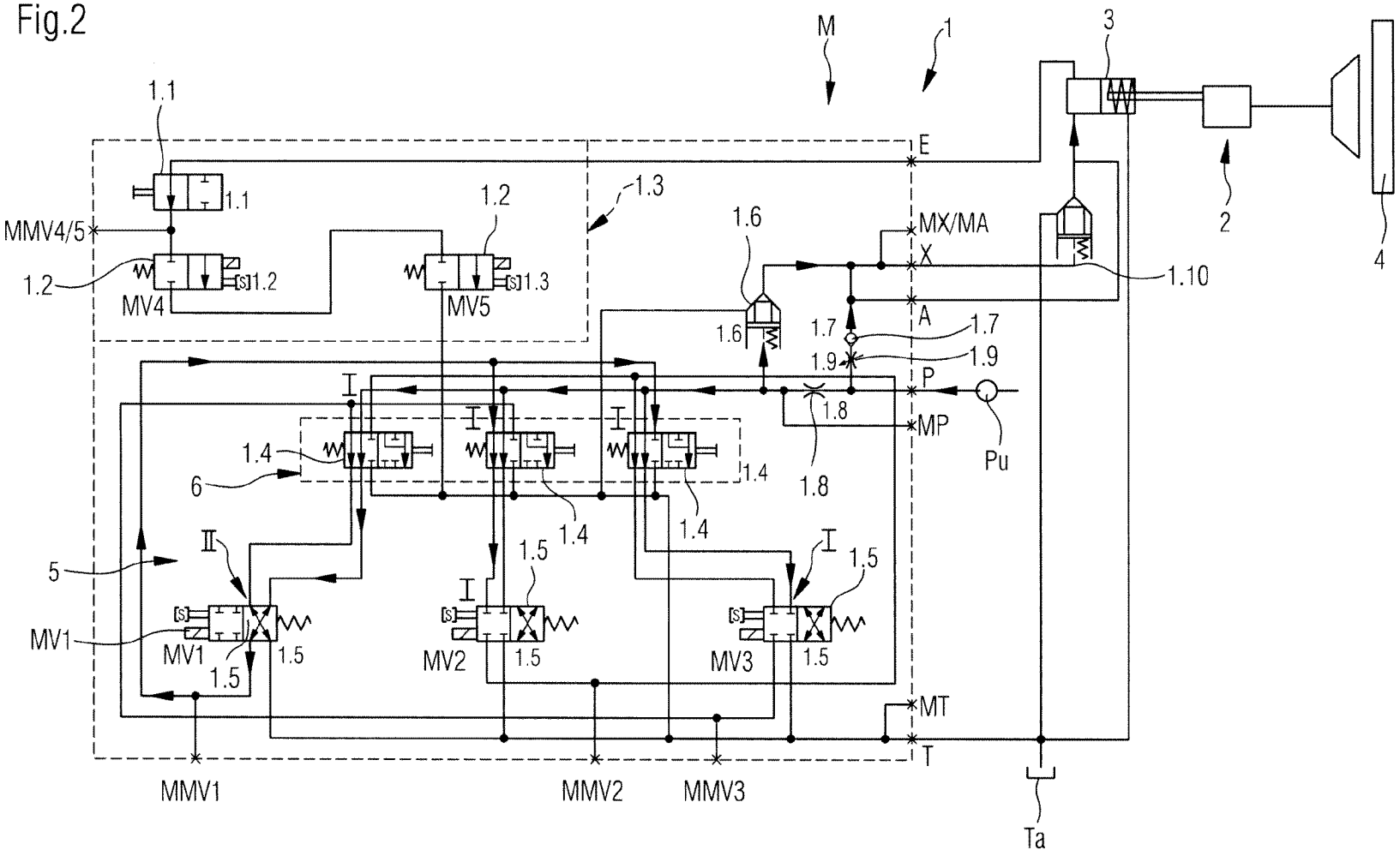
FIG. 2 shows a control device according to FIG. 1, however, compared with FIG. 1, with a defective safety transfer valve (MV1) and an external outflow valve.

FIG. 2 reflects a situation in which the safety transfer valve 1.5 with the designation MV1 is defective. The same remains for example in the opened position II while the other multiple transfer valves MV2 and MV3 are in the valve position I. In order to now replace MV1 the precontrol valve 1.4 corresponding with the same, in particular multiple transfer valve has to be actuated and from its position I shown according to FIG. 1 transferred into the at least one further position II. In this position II—reflected in FIG. 3—the inlet Z1 and Z5 is connected with the outlet A6. The further inlet Z3 and the further outlets A2 and A4 are closed. The outlet A6 is connected in terms of fluid with the further safety transfer valves 1.5 with the designation MV2 and MV3. Both safety transfer valves 1.5 with the designation MV2 and MV3 are in the closed position I.

Figure 3:
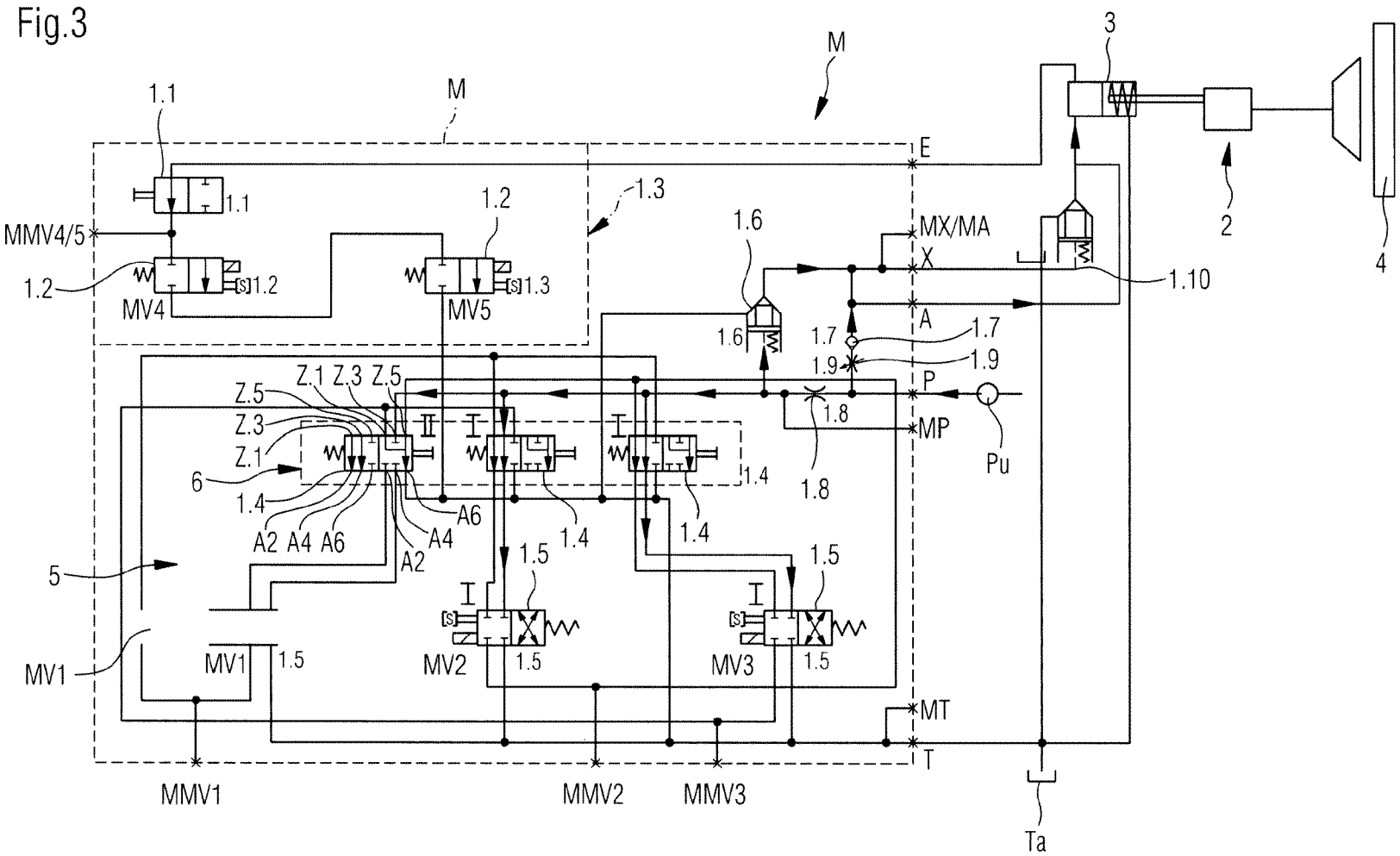
FIG. 3 shows a control device according to FIG. 2, however, compared with FIG. 2, with a circuit arrangement for removing the safety transfer valve (MV1) during running operation and an external outflow valve.

When the position of the multiple transfer valve 1.4 shown in FIG. 3 is reached, the safety valve 1.5 connected downstream of the same, here MV1, can be removed and replaced during running operation. The switching logic for the actuation of the emergency stop valve 2 automatically changes from a 2oo3 trip into a 1oo2 (one out of two).

Figure 4:
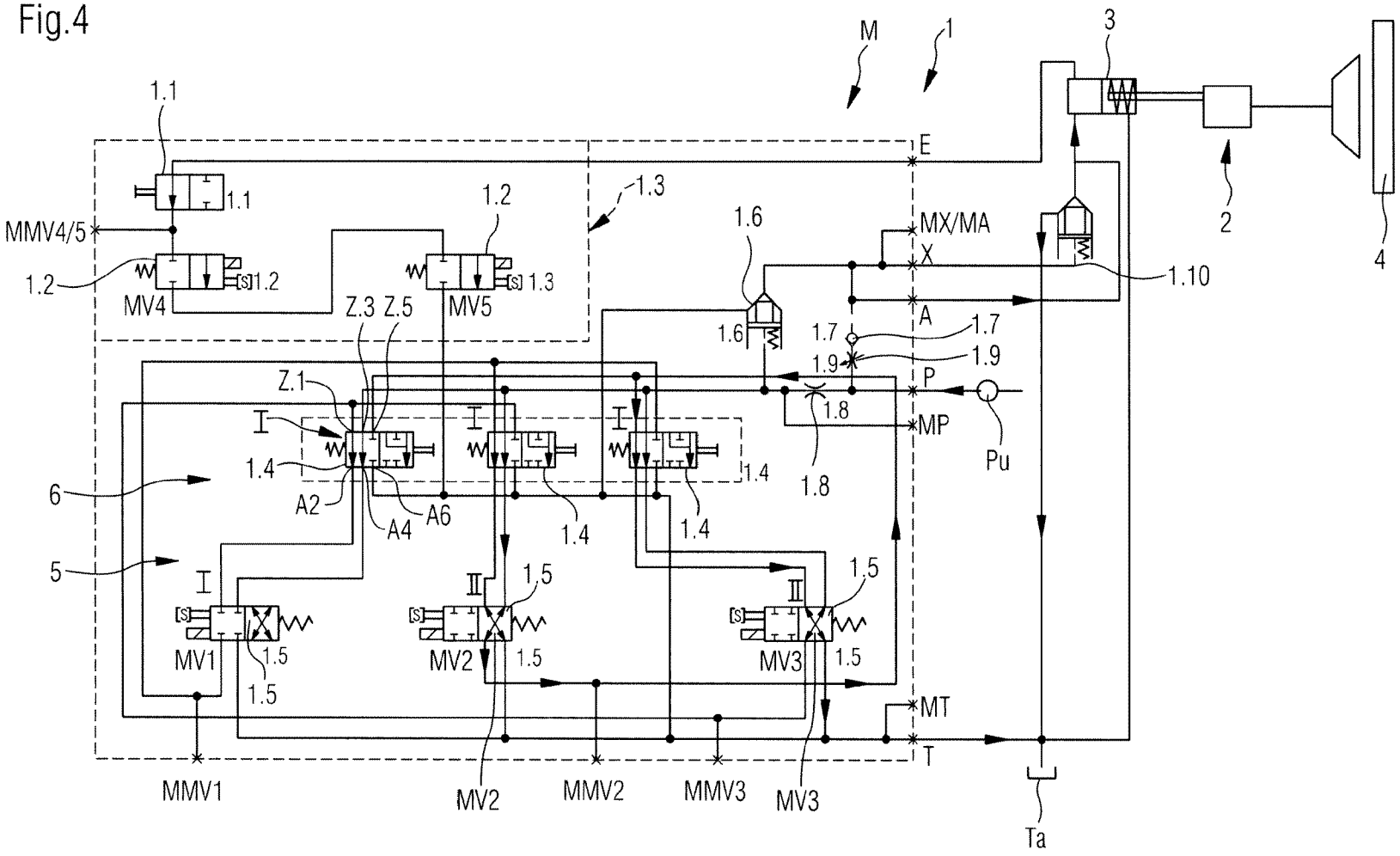
FIG. 4 shows a control device according to FIG. 1, however, compared with FIG. 1, with triggered emergency stop valve and an external outflow valve.

When two or three safety transfer valves 1.5 are switched off in any combination or order—as for example reflected for the safety transfer valves MV2 and MV3 in FIG. 4—, the connection between the connector P and the connector T is established. The control fluid can flow off into the tank Ta. The control fluid of the actuator 3 flows off to the tank Ta via an outflow valve 1.6. In addition, the external outflow valve 1.10 supports in terms of shortening the emergency stop time.

A reliable over speed protection is indispensible for turbomachines. For gas and steam turbines, this means a safe detection of the over speed and as reaction an immediate closing of the emergency stop valve. This hydraulic control device offers both functions in one device. An electronic evaluation unit detects the over speed and an electrohydraulic assembly assumes the direct activation of the emergency stop valve 2.

The switchability of the individual valve devices is realized by way of suitable actuating devices. The switchability of the safety valves, which is characterized by realizing the at least two valve positions, can be realized in different ways here. Preferentially, electromagnetic actuating devices are employed. The actuating devices of the precontrol valves 1.4 can be actuated mechanically, electrically, hydraulically or in other ways. Preferentially, these are actuated manually mechanically against spring force in the event of replacement.

In all figures, the connectors mentioned in the following are reflected on the module M:

Connector P to the pump Pu, connector T to the tank Ta, connector MMV1 to MV1, connector MMV2 to MV2, connector MMV3 to MV3, connector MMV4 to MV4, connector MMV5 to MV5, connector X to the outflow valve 1.10, connector A to the actuator 3 in the bypass to the outflow valve 1.10. Also reflected is a throttle 1.8 and 1.9 in the connection to the pump Pu and to the outflow valve 1.10 and the actuator 3 respectively.

LIST OF REFERENCE CHARACTERS

1 Control device
1.1 Transfer valve
1.2 Transfer valve
1.3 Test control valve arrangement
1.4 Precontrol valve
1.5 Safety valve, in particular safety transfer valve
1.6 Outflow valve
1.7 Non-return valve
1.8 Throttle
1.9 Throttle
1.10 Outflow valve
2 Emergency stop valve
3 Actuator
4 Turbine
5 Operating medium conducting and/or supply system
6 Control valve arrangement
Ta Tank
Pu Pump
M Module
MV1 Multiple transfer valve
MV2 Multiple transfer valve
MV3 Multiple transfer valve
MV4 2/2-way valve
MV5 2/2-way valve
P Connector
T Connector
MMV1, MMV2,
MMV3, Connectors to the multiple transfer valves MV1, MV2,
MV3
MMV4, MMV5 Connectors to the 2/2-way valves MV4, MV5
X, A Connectors
A2, A4, A6 Outlets on the precontrol valve
Z1, Z3, Z5 Inlets on the precontrol valve

The invention claimed is:

1. A hydraulic control device for an emergency stop valve of a steam turbine, comprising:

a module for reducing a hydraulic pressure by rapid opening of an outflow valve and/or changing a load on an actuator for actuating the emergency stop valve;

a control valve arrangement with at least three safety valves provided in an operating medium supply and/or conducting system, said at least three safety valves being hydraulically interconnected to open the outflow valve or change a load on the actuator only when a safety circuit by way of at least two safety valves of said control valve arrangement have assumed an emergency stop position;

at least three precontrol valves, with a respective said precontrol valve hydraulically connected upstream, in a flow direction from a pressure source towards a pressure sink, of each said safety valve and independent from remaining said safety valves, wherein the respective said safety valve that is connected downstream of a respective said precontrol valve can be hydraulically decoupled from the respective said precontrol valve during operation, and wherein said three precontrol valves are connected in parallel.

2. The control device according to claim 1, wherein said three precontrol valves are hydraulically coupled to one another.

3. The control device according to claim 2, which comprises a common connection line with a pressure source and a common connection line with a pressure sink hydraulically coupling said precontrol valves to one another.

4. The control device according to claim 1, wherein each individual said precontrol valve is configured to assume at least two valve positions, namely:

a first valve position, in which a connector for direct or indirect coupling of said precontrol valve to a pressure source is fluidically connected with a connector for a direct or indirect fluidic connection with a connector on said safety valve; and a second valve position, in which a connector for direct or indirect coupling of said precontrol valve with a pressure source is fluidically separated from a connector for direct or indirect fluidic connection with a connector on said safety valve.

5. The control device according to claim 1, wherein each said precontrol valve is a multiple transfer valve.

6. The control device according to claim 5, wherein each said multiple transfer valve is a 6/2-way valve.

7. The control device according to claim 1, wherein each said safety valve is a safety transfer valve, comprising:

at least two connectors including a connector for direct or indirect coupling with a pressure source and a connector for direct or indirect coupling with a pressure sink;

at least two valve positions, including:

a first valve position in which said connector on said safety transfer valve for fluidic connection with said precontrol valve connected upstream of the respective said safety transfer valve is fluidically disconnected or shut off with a connector on said safety transfer valve (1.5) for coupling with a pressure sink; and a second valve position in which said connector on said safety transfer valve for fluidic connection with said precontrol valve connected upstream of the respective said safety transfer valve is fluidically connected to a connector on said safety transfer valve for coupling with a pressure sink.

8. The control device according to claim 7, wherein each said safety transfer valve is a multiple transfer valve, comprising two connectors in each case for a fluidic connection with connectors on said precontrol valve connected upstream of said safety transfer valve, a connector for coupling with a pressure sink, and a connector for a fluidic coupling with a connector on one of the other said precontrol valves.

9. The control device according to claim 8, wherein each said safety transfer valve is a 4/2-way valve.

10. The control device according to claim 1, which further comprises a test control valve arrangement including at least one transfer valve for carrying out a partial stroke test.

11. The control device according to claim 10, wherein said at least one transfer valve of said test control valve arrangement is one of two 2/2-way valves arranged in series.

12. The control device according to claim 1, which comprises an external outflow valve connected between the actuator interacting with the emergency stop valve and the module.

13. A steam turbine arrangement, comprising a steam turbine, a steam mass flow supply assigned to said steam turbine, and an emergency stop valve in said steam mass flow supply, and a hydraulic control device according to claim 1 assigned to said emergency stop valve.

* * * * *